US006274237B1

(12) United States Patent
Nakajima et al.

(10) Patent No.: US 6,274,237 B1
(45) Date of Patent: Aug. 14, 2001

(54) POTENTIALLY CRIMPABLE COMPOSITE FIBER AND A NON-WOVEN FABRIC USING THE SAME

(75) Inventors: Yuji Nakajima, Saitama; Koji Minamoto; Masayasu Suzuki, both of Shiga, all of (JP)

(73) Assignee: Chisso Corporation, Osaka (JP)

( * ) Notice: Subject to any disclaimer, the term of this patent is extended or adjusted under 35 U.S.C. 154(b) by 0 days.

(21) Appl. No.: 09/574,223

(22) Filed: May 19, 2000

(30) Foreign Application Priority Data

May 21, 1999 (JP) ..... 11-142358

(51) Int. Cl.[7] ..... D01E 8/00; D01E 8/06
(52) U.S. Cl. ..... 428/370; 428/374
(58) Field of Search ..... 428/364, 370, 428/373, 374; 442/632, 364

(56) References Cited

U.S. PATENT DOCUMENTS 5,780,155 * 7/1998 Ishizawa et al. ..... 428/370
5,993,964 * 11/1999 Nakajima ..... 428/364
6,001,752 * 12/1999 Ishizawa et al. ..... 442/632

FOREIGN PATENT DOCUMENTS 2-191720 7/1990 (JP) .
8-92852 4/1996 (JP) .

* cited by examiner

*Primary Examiner*—N. Edwards
(74) *Attorney, Agent, or Firm*—McDermott, Will & Emery

(57) ABSTRACT

The invention is directed to a crimpable composite fiber having a propylene copolymer is the first component and a polyethylene as the second component.

7 Claims, 1 Drawing Sheet

POTENTIALLY CRIMPABLE COMPOSITE FIBER AND A NON-WOVEN FABRIC USING THE SAME

BACKGROUND

1. Technical Field of the Invention

This invention relates to a potentially crimpable polyolefin composite fiber which potential crimp emerge under thermal treatment, and a non-woven fabric using the same.

2. Description of Related Art

As one of the methods for obtaining lofty non-woven fabrics, it has been a conventionally known method to use fiber with a zigzag shape crimp given by mechanical crimping means such as a stuffer box, or using a side-by-side or an eccentric sheath-core composite fiber spirally crimped by means for generating strain in the fiber such as stretching.

For example, proposed in Japanese Patent Application No. Hei 1-5093 (Publication No. Hei 2-191720) is a sheath-core composite fiber arranged with an ethylene-propylene random copolymer mainly as the sheath component and a crystalline polypropylene as the core component. This fiber is aimed to obtain a lofty non-woven, wherein potential crimp emerge under thermal treatment in the non-woven fabric production process by taking advantage of thermal shrinkage of the ethylene-propylene random copolymer arranged as the sheath component. However, friction against metals of the ethylene-propylene random copolymer of the sheath component is much higher than other resins generally used for fibers, for example, high density polyethylene, so that this fiber is not ejected well from a carding machine, and it is difficult to obtain a uniform web; also the obtained non-woven fabric has peculiar greasy or sticky feeling resulting from the nature of raw material of the sheath component. Further, the fiber is generally opened with hopper feeder and transferred to the carding machine through an air blowing duct, but the fiber having high friction against metals has an impaired transferring problem that the fiber sticks to the inside of air blowing duct. In the case of spinning continuous filaments of composite fiber combining these resins with spun-bond method in which the carding process is not required, it is also a problem that the fiber is not well opened due to the fiber's inter-friction caused by the ethylene-propylene random copolymer covering the surface of the fiber, and web accumulated onto conveyer is not uniform. As mentioned the above, lofty and high quality non-woven fabric using potentially crimpable fiber has not been actually obtained up to now, but requirement for lofty non-woven fabric having better touch feeling has been heightened, with escalated market competition of disposable diapers and sanitary materials.

This invention aims to solve the above problem and to provide a lofty non-woven fabric having good touch feeling and its raw material of a potentially crimpable fiber.

SUMMARY OF THE INVENTION

The inventors of this invention diligently have given an investigation to solve the above problem, and have got the reduction to practice of this invention to find the following means, which is the constitution of this invention.

(1) A potentially crimpable composite fiber comprising;

a propylene copolymer having melting point (Tm) of 120° C. Tm 147° C. consisting of 90 to 98 weight % of propylene and 2 to 10 weight % of α-olefin other than propylene as the first component, and a polyethylene as the second component, wherein its composite configuration of the first and the second components is eccentric sheath-core configuration where the second component is arranged as the sheath component, and the area ratio of the first component to the second component in the fiber cross section is 65/35–35/65.

(2) The potentially crimpable composite fiber according to the above article (1), wherein the propylene copolymer of the first component consists of 90 to 96 weight % of propylene and 4 to 10 weight % of α-olefin other than propylene.

(3) The potentially crimpable composite fiber according to the above article (1), wherein the propylene copolymer of the first component is an ethylene—propylene—butene-1 copolymer consisting of 90 to 96 weight % of propylene, 3 to 7 weight % of ethylene and 1 to 5 weight % of butene-1.

(4) The potentially crimpable composite fiber according to the above article (1), wherein the second component consists of at least one selected from a group of a high density polyethylene, a linear low density polyethylene and a low density polyethylene.

(5) The potentially crimpable composite fiber according to the above article (1), wherein the melting point of the second component is lower than that of the first component (Tm).

(6) The potentially crimpable composite fiber according to the above article (1), wherein the potentially crimpable composite fiber is a continuous filament.

(7) A non-woven fabric comprising the potentially crimpable composite fiber according to the above article (1).

Figure 1:
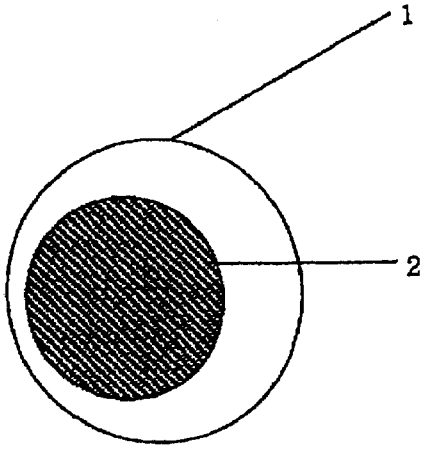
FIG. 1 shows the cross section of an eccentric sheath-core composite fiber.

Explanation of Symbols 1, 3, 5: The second component of eccentric sheath-core composite fiber.

2, 4, 6: The first component of eccentric sheath-core composite fiber.

DETAILED DESCRIPTION OF THE INVENTION

This invention is described in more detail as the followings.

PREFERRED EMBODIMENT OF THIS INVENTION

The following description provides preferred embodiment of this invention. But this invention is not limited within the following description.

As the first component constituting the potentially crimpable fiber of this invention, exemplification is a propylene copolymer which shrinks at a relatively low temperature and which can be formed into a fiber, from the view point of processability.

The propylene copolymer defined in this invention is a copolymer of propylene polymerized with small amount of at least one kind of α-olefin other than propylene such as ethylene, butene-1, pentene-1, hexene-1, hepten-1, octene-1, 4-methyl-pentene-1 and so on. The exemplification of the propylene copolymers are ethylene-propylene copolymer, propylene-butene-1 copolymer, ethylene-propylene-butene-1 copolymer, propylene-hexane-1 copolymer, propylene-octene-1 copolymer the mixture of at least two of these kind of copolymers and so on. These copolymers are usually random copolymer, but block copolymer is also favorably applied to the fiber of this invention.

As the first component constituting the potentially crimpable fiber of this invention, ethylene-propylene copolymer consisting of 1 to 10 weight % of ethylene and 90 to 99 weight % of propylene or ethylene-propylene-butene-1 copolymer consisting of 1 to 5 weight % of ethylene, 90 to 98 weight % of propylene and 1 to 7 weight % of butene-1 are favorable from the view point of cost, more preferably ethylene-propylene copolymer consisting of 4 to 10 weight % of ethylene and 90 to 96 weight % of propylene or ethylene-propylene-butene-1 copolymer consisting of 3 to 7 weight % of ethylene, 90 to 96 weight % of ethylene and 1 to 5 weight % of butene-1 from the standpoint of shrinkage, lower heat processability at shrinking treatment process. A copolymer having a melting point Tm (°C.) Less than 120° C. give a bad influence on carding processability of obtained fiber arisen from its rubber elasticity. Contrary, in the case of using a copolymer having a melting point Tm more than 147° C. shrinkage of obtained fiber deteriorate to be level of ordinary polypropylene fiber or polyethylene/polypropylene fiber. Accordingly, using the polypropylene copolymer having the above mentioned composition range enables to obtain the potentially crimpable fiber having both of cardability and thermal shrinkage. Furthermore, from the view point of low thermal processability at shrinking treatment process under thermal treatment, it is more preferable to use a propylene copolymer consisting of 90–96 weight % of propylene and 4–10 weight % of α-olefin(s) other than propylene as the first component, that is, an ethylene-propylene copolymer consisting of 90–96 weight % of propylene and 4–10 weight % of ethylene, or an ethylene-propylene-butene-1 copolymer consisting of 90–96 weight % of propylene, 3–7 weight % of ethylene and 1–5 weight % of butene-1.

Additionally, inorganic material(s) such as titanium dioxide, calcium carbonate or magnesium hydroxide, or flame retardant(s), pigment(s), and other polymer(s) may be added to the first component if necessary, within the range that the thermal shrinkage of the fiber of this invention does not extremely degraded, or the thermal shrinkage is lightly controlled.

As the polyethylene which can be used for the second component of the potentially crimpable fiber of this invention, exemplified is the high density polyethylene, the linear low density polyethylene or the low density polyethylene, being classified based on its density and melting point as the following.

The high density polyethylene defined in this invention is a homopolymer of ethylene or a copolymer consisting of ethylene and maximum 2 wt % of C3–C12 α-olefin as a comonomer, polymerized by low pressure method using conventional Ziegler-Natta catalyst, and generally having 0.941–0.965 g/cm$^3$ of density and not less than 127° C. of melting point.

The linear low density polyethylene defined in this invention is a copolymer consisting of ethylene and generally 15 wt % or less of C3–C12 α-olefin as a comonomer, polymerized with conventional Ziegler-Natta catalyst, substantially having no branched long chain, and generally having 0.925–0.940 g/cm$^3$ of density and less than 127° C. of melting point.

The low density polyethylene defined in this invention is a polyethylene polymerized by high pressure method, generally having 0.910–0.940 g/cm$^3$ of density and 120° C. or less of melting point, having many branched chains, and low crystallinity.

Furthermore as the second component of this invention, a polyethylene resin polymerized with a metallocene catalyst also can be exemplified. The polyethylene resin polymerized with a metallocene catalyst contributes to spinning stability, because its molecular weight distribution is narrower than the above mentioned polyethylene resins, so that it can be used favorably.

Additionally, when producing the potentially crimpable fiber of this invention, the several kinds of the above mentioned polyethylene resins can be mixed to provide processability at low temperature and process stability, and inorganic material(s) such as titanium dioxide, calcium carbonate or magnesium hydroxide, or flame retardant(s), pigment(s), and other polymer(s) may be added to the second component if necessary, within the range that the aim of this invention is never hindered.

In the potentially crimpable fiber of this invention, it is possible to give thermobondability to the fiber by using a polyethylene having lower melting point than that of the first component Tm (°C.) as the second component. In other words, when resins of the first and second components are appropriately selected to have melting point difference, it is possible to bond fiber thermally to another with emboss processing or heat-pin processing on a web wherein each fibers are entangled by hydroentanglement process to increase strength or to adjust elasticity of the non-woven fabric without losing good touch feeling and bulkiness of the non-woven fabric. Specifically in the case of the thermal treatment within the temperature range between the melting points of the first and second components, both of non-woven fabrication and shrinking treatment can be done at the same time, so that the process for producing non-woven fabric can be simplified. In addition to this, the melting point of the second component is preferably 5° C. or more lower than that of the first component Tm, more preferably 10° C. or more lower than Tm.

Also it is possible to produce non-woven fabric only to make each fibers entangled by making potential crimp emerge but without making the fibers heated up to the temperature more than melting point of the first and second component. In this case, it is not necessary that the melting point of the second component is lower than that of the first component Tm, as long as the potential crimp can be turned into actual crimp at a temperature lower than the melting points of both component.

The composite configuration of the potentially crimpable fiber in this invention is necessary to be an eccentric sheath-core configuration where the second component is arranged as the sheath component. Because if the composite configuration of the fiber is concentric sheath-core configuration, sufficient crimp for the bulkiness is not actualized even under thermal treatment. And the area ratio of the second component to the first component (area ratio of the sheath component to the core component in the cross section of the fiber cut perpendicularity to the fiber axis) is preferably in the range of 35/65 to 65/35, more preferably in the range of 45/55 to 55/45. If the area ratio of the first component is much less than 35%, shrinkage of the potential crimpable fiber is weakened and sufficient crimp can not emerge, so that lofty non-woven fabric can be hardly obtained. Contrary to this, if the area ratio of the first component is much more than 65%, shrinkage of the fiber becomes too large, so that it is difficult to shrink the non-woven fabric uniformly, and in extreme cases, fiber lumps appear and non-woven fabric can not be obtained.

Figure 2:
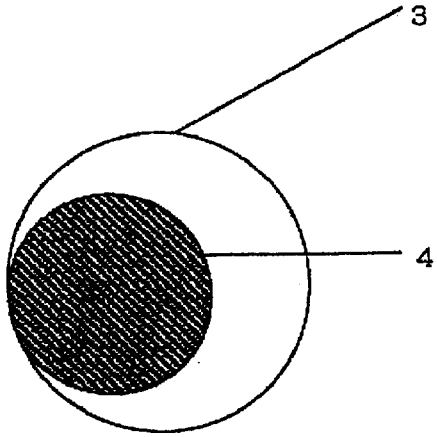
FIG. 2 shows the cross section of an eccentric sheath-core composite fiber. (Eccentricity is increased)
Figure 3:
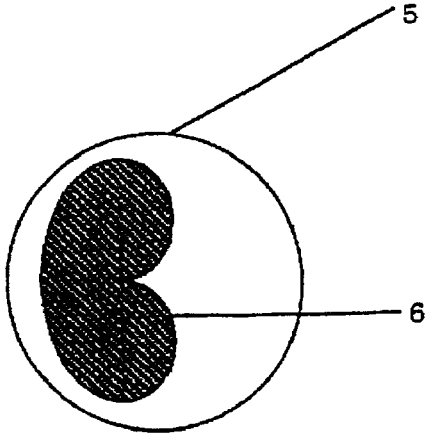
FIG. 3 shows the cross section of an eccentric sheath-core composite fiber having non-circular core component.

Exemplary embodiments of the cross section of the potentially crimpable fiber in this invention are shown in attached FIGS. 1 to 3. An arrangement of the eccentric sheath-core configuration shown in FIG. 1 is generally applied, but a more eccentric configuration shown in FIG. 2, which the first component is partially exposed on the surface of the fiber, is also applicable as long as the effect of this invention is not inhered by friction of the first component, because the potential crimpability of the thermal shrinkage difference is heightened. Further in the case of a non-circular cross section of the first component shown in FIG. 3, the potential crimpability of the thermal shrinkage difference is also heightened.

It is preferable that the potentially crimpable composite fiber of this invention shows a thermal shrinkage of at least 50% in machine direction (denoted as MD hereinafter) of conditioned web, and more preferably, it shows the thermal shrinkage of at least 60% in MD and at least 40% in cross direction (denoted as CD hereinafter) when it is used as mixed with other fibers. If the thermal shrinkage in MD is much lower than 50%, the obtained non-woven fabric is not lofty.

As the method for producing the fiber of this invention, conventional method such as melt-spinning method, spun-bond method and melt-blown method can be exemplified, and adapting these methods appropriately, multi-filaments, mono-filaments, staple fibers, tows and non-woven fabrics can be obtained.

When using the potentially crimpable fiber of this invention as a staple fiber which requires to be carded, it is necessary to provide actual crimp to the fiber. Use of mechanical crimping means, such as a so-called stuffing box, is not the only method for providing actual crimp. One may also use the elongation elasticity difference between a first and second component to impart a three-dimensional spiral crimp, without using a stuffing box.

In the general case of processing the fiber into the web with a carding machine, it is necessary to provide an appropriate number of crimps to the fiber to make the fiber cardable well. The appropriate number of crimps depends on the fineness of the fiber, but it is preferably 10 to 25 crimps/inch in general. If the number of crimps is much less than this range, the fiber tends to stick on cylinder or doffer under carding process and neps is generated or the web is torn. And the number of crimps is much more than this range, a uniform web is difficult to be obtained or neps appear. So the number of crimps should be adjusted in the above range to obtain a lofty non-woven fabric having good touch feeling.

Fineness of the fiber is also not limited, and depends on usage of the fiber. For example, in the case of using the fiber for hygienic materials represented by disposable diapers or sanitary napkins, it is preferably in the range of 0.1 to 10 dtex, for needle punch carpets or tufted carpets, it is preferably in the range of 8 to 80 dtex, and for materials of construction such as mono-filaments, it is preferably in the range of 50 to 7000 dtex.

In the melt-spinning method for producing the potentially crimpable fiber in this invention as a short fiber, cut length of the fiber is not limited and may be appropriately set depending on processing method or usage of the fiber. In the case of obtaining a fiber web such as a random web, a parallel web or a cloth wrap web using roller carding machine or random webber, the cut length is preferably 20 to 125 mm, and 25 to 75 mm is more preferable for good cardability and uniformity of the web. In the case of producing the fiber web by air laid method or papermaking method, the cut length is preferably less than 20 mm.

To produce lofty non-woven fabric using the potentially crimpable fiber of this invention, it is necessary to actualize the potential crimp by thermal treatment on the aggregated fiber (web) comprising mainly the potentially crimpable fiber of this invention, and to shrink the web to be formed into one. For the thermal treatment, a conventional thermo-treating machine such as a hot air circulating machine or a floating dryer, etc. can be used. Among them, using the floating dryer is especially preferable because it can shrink the web much more uniformly. This machine is characterized that jetting heated air from nozzles arrayed at upside and downside of conveying space of the web, floating the web with the heated air, and making the fiber shrink at the same time while air conveyance, so that much more uniform non-woven fabric can be obtained. However, in any case of using the said thermo-treatment machines, it is highly important to make the fiber temporary fixed each other by needle-punching method, embossing roll method, supersonic melt-adhesion method and/or high pressure hydro-entanglement method to avoid the web to be torn or the fiber to be scattered.

The potentially crimpable composite fiber of this invention can be used not only itself alone but also used with other fiber as mixed, combined, blended, mix-knitted or mix-woven for primary fiber products such as fiber moldings and the like. After actualizing the potential crimpability, the fiber of this invention has proper elasticity and good hand touch feeling, so that it is further processed with secondary processing to be applicable widely for many fields including the apparel clothing field such as underwears, shirts, blouses, socks and Tabi (Japanese socks), the bedclothes field such as clothes-wadding, outer clothes of Japanese Futon, sheets, bedcovers, pillowcases and floor cushions, the medical usage field such as surgical masks, surgical gowns, surgical caps, cloths for consultation, gauze, bandages and adhesive plasters, the hygienic materials field such as sanitary napkins, disposable diapers and incontinence pads, the interior usage field such as carpet, curtain and wallpaper, the field of inner cloths of shoes, inner bottom of shoes and related, the agricultural field such as fruits protection materials and preventing animal's eating, and other fields such as confectionery wrapping materials, food wrapping materials, wrapping cloths, towels, wet towels, scrubbing brushes, tablecloths, aprons, kitchen cloths, cosmetic puffs, teabags, wiping cloths and filters. The other fiber used for mixing, combining, blending, mix-knitting or mix-weaving is not limited, and polyamide fiber such as nylon-6 and nylon-66, polyester fiber such as polyethylene terephthalate and polybutylene terephthalate, polyolefin fiber such as polypropylene, polyethylene and polypropylene/polyethylene composite fiber can be used for variable purposes.

The basis weight of the non-woven fabric comprising the potentially crimpable composite fiber of this invention is appropriately chosen depending on its purpose of usage. For example, the usage for outer surface material of the absorbent article, 5 to 100 g/m$^2$. is preferable basis weight range, and the usage for the civil engineering material such as a drain material, 50 to 2000 g/m$^2$. is preferable. Further, the non-woven can be layered for its purpose of usage, for example such layered configuration is spun-bonded non-woven fabric/the non-woven fabric comprising the potentially crimpable composite fiber/spun-bonded non-woven fabric, a combination of spun-bonded non-woven fabric/melt-brown non-woven fabric/the non-woven fabric comprising the potentially crimpable composite fiber, and so on.

EXAMPLES

This invention is explained in more specifically with examples hereinafter, but this invention is not limited by the following examples. The definition of terms used in the Examples and Comparative Examples and their experimental methods are the following.

(1) Melting Point: (unit °C.)

The temperature corresponding to the peak of the melt endothermic curve measured by Du Pont's differential scanning calorimeter DSC-10 at 10° C./min. of programming rate was defined as the melting point of the tested thermoplastic polymer.

(2) MFR (unit: g/10 min.)

MFR was measured according to Condition No. 14 of JIS K 7210 (230° C., 21.18 N). MFR (before spinning) was obtained on the thermoplastic polymer used as the raw material of fiber shown in tables, and MFR (after spinning) is obtained on extruded thermoplastic polymer from spinning device employed in each examples.

(3) Q Value (weight average molecular weight/number average molecular weight)

Q value (Mw/Mn) is the ratio of weight average molecular weight (Mw) to number average molecular weight (Mn) those were measured by gel permeation chromatograph method. The Q values shown here are the values of crystalline polypropylene and propylene copolymer measured before spinning.

(4) Fineness (unit: dtex)

Diameters of a hundred of single fibers were measured from the obtained scanning electron microscope image, and the average of diameter was used to obtain fineness of fiber.

(5) Number of Crimps (unit: crimps/inch)

Number of crimps per inch were counted on ten single fibers and the average was defined as the number of crimps.

(6) Thermal Shrinkage (unit: %)

A 25×25 cm piece of arranged web having approximately 200 g/m$^2$ of basis weight was layered on kraft paper and put in convection hot air dryer kept at 145° C. for thermal treatment of 5 minutes. Then the length in MD and CD(a cm) of thermally-treated web were measured respectively, and the thermal shrinkage was calculated according to the following equation.

$$\text{Thermal shrinkage of web } (\%) = (1 - a/25) \times 100$$

(7) Spinnability

The spinnability was examined by the following standard to three ranks, by counting times of breakage in ten hours while the melt-spinning method is carried out.

Very Good: No breakage occurred, and most suitable for production.

Good: 1 or more and less than 3 times of breakage occurred.

Bad: 4 or more times of breakage occurred, and lack of productivity.

(8) Cardability 50 g of raw stock of fiber was supplied into miniature carding machine, and the cardability was determined by observing the state of fiber in the carding machine and web ejected from the carding machine according to the following standard.

Suitable: Web was uniform and had good appearance, also ejected well.

Not Suitable: Fiber was stick to cylinder or doffer of the carding machine, and lack of processing.

(9) Uniformity

A web having approximately 20 g/m$^2$ of basis weight was put into convection hot air dryer kept at 145° C. for thermal treatment of 1 minute, and the uniformity of the web was determined by observation according to the following standard as ranked in three levels.

Very Good: Uniform thermal shrinkage occurred, and obtained non-woven fabric has good appearance.

Good: Relatively uniform thermal shrinkage occurred, a little uneven formation was observed, but no problem for practical use.

Bad: Uniform thermal shrinkage did not occur and formation was uneven, or shrinkage ratio was small.

(10) Touch Feeling

A web having approximately 20 g/m$^2$ of basis weight was put into convection hot air dryer kept at 145° C. for thermal treatment of 1 minute. The touch feeling of the thus obtained samples was examined by sensory test that 10 testers touch the samples and scored its level of touch feeling according to the following standard as ranked in four points, then the average of the points are rounded off to ten decimal place to determine touch feeling level.

4. The non-woven fabric was lofty, elastic, and its surface was smooth and soft.

3. The non-woven fabric was lofty and soft, but slightly lacked of elasticity or smoothness.

2. The non-woven fabric was not lofty and hard, also lack of elasticity.

1. The non-woven fabric almost never shrunk, was torn by light tension, so problem for practical use.

(11) Openability

The fiber spun with spun-bonding device was collected on endless track net conveyer, and opening state of the collected continuous fiber web was examined with observation according to the following standard as ranked in three levels.

Very Good: Opening was uniformly done.

Good: Opening was almost uniformly done with little unevenness.

Bad: Opening was uneven, and the web was not suitable for practical use.

Examples 1–8, Comparative Examples 1–4

One of ethylene-propylene-butene-1 copolymer, ethylene-propylene copolymer and crystalline polypropylene and one of high density polyethylene, linear low density polyethylene, low density polyethylene, polyester (intrinsic viscosity value 0.67), crystalline polypropylene and were employed as the first and second component of composite fibers respectively. Fibers were produced with a spinning device equipped with an extruder, a spinneret of 0.8 mm diameter for eccentric sheath-core configuration or concentric sheath-core configuration and a winder; a stretching device equipped with multiple-stage heating rolls and a stuffer box. And the thermal shrinkage of obtained fibers was measured.

In addition to the following Examples and Comparative Examples, spinning was carried out to form the cross sectional shape of composite fiber shown in FIG. 1 or FIG. 2, but other eccentric sheath-core structure with a non-circular cross section shape of core component as shown in FIG. 3 is also possible to adopt.

Concerning to each data of the composite fibers and the non-woven fabrics, those of Example 1–8 are shown in Table 1–2, and Comparative Examples are shown in Table 3.

TABLE 1

| | | | | Example 1 | Example 2 | Example 3 | Example 4 | Example 5 |
|---|---|---|---|---|---|---|---|---|
| 1st component | Polymer (resin) | | | Co-PP | Co-PP | Co-PP | Co-PP | Co-PP |
| | Monomers | Propylene | wt % | 95.70 | 96.60 | 93.35 | 94.00 | 93.50 |
| | | Ethylene | wt % | 3.00 | 3.40 | 4.00 | 1.00 | 5.50 |
| | | Butene-1 | wt % | 1.30 | 0 | 2.65 | 5.00 | 1.00 |
| | Melting point TM | | ° C. | 136.5 | 137.0 | 126.4 | 140.2 | 124.2 |
| | MFR (before spinning) | | g/10 min. | 17 | 17 | 16 | 18 | 20 |
| | MFR (after spinning) | | g/10 min. | 34 | 36 | 30 | 36 | 42 |
| 2nd Component | Polymer (resin) | | | HDPE | HDPE | HDPE | HDPE | LLDPE |
| | Melting point | | ° C. | 132.0 | 132.0 | 132.0 | 132.0 | 123.1 |
| Spinning condition | Composite configuration | | | FIG. 2 | FIG. 1 | FIG. 1 | FIG. 1 | FIG. 1 |
| | Ratio of sheath/core | | Weight ratio | 50:50 | 50:50 | 50:50 | 40:60 | 50:50 |
| | Spinning temperature | | ° C. | 250 | 250 | 250 | 250 | 250 |
| | Fineness of unstretched fiber | | dtex | 8.8 | 8.7 | 8.8 | 8.8 | 8.6 |
| Stretching condition | Stretching temperature | | ° C. | 90 | 90 | 90 | 90 | 90 |
| | Stretching ratio | | Times | 4.5 | 4.3 | 4.7 | 4.4 | 4.6 |
| | Shape of crimps | | | Three dimensional crimps | Mechanical crimps | Three dimensional crimps | Mechanical crimps | Mechanical crimps |
| | Number of crimps | | crimps/2.54 cm | 10.9 | 11.8 | 12.5 | 11.1 | 13.7 |
| Property of Fiber | Fineness | | dtex | 2.3 | 2.4 | 2.2 | 2.4 | 2.2 |
| Thermal Shrinkage | MD/CD | | %/% | 75/69 | 66/56 | 78/72 | 69/63 | 78/74 |
| Processability | Spinnability | | | Very Good | Very Good | Very Good | Very Good | Very Good |
| | Cardability | | | Suitable | Suitable | Suitable | Suitable | Suitable |
| State of non-woven fabric | Uniformity | | | Very Good | Very Good | Very Good | Very Good | Very Good |
| | Touch feeling | | | 4 | 3 | 4 | 4 | 4 |

HDPE: High density polyethylene
LLDPE: Linear low density polyethylene
Co-PP: Propylene copolymer

TABLE 2

| | | | | Example 6 | Example 7 | Example 8 |
|---|---|---|---|---|---|---|
| 1st component | Polymer (resin) | | | Co-PP | Co-PP | Co-PP |
| | Monomers | Propylene | wt % | 95.60 | 93.35 | 93.35 |
| | | Ethylene | wt % | 4.40 | 4.00 | 4.00 |
| | | Butene-1 | wt % | 0 | 2.65 | 2.65 |
| | Melting point TM | | ° C. | 133.5 | 126.4 | 126.4 |
| | MFR (before spinning) | | g/10 min. | 12 | 16 | 16 |
| | MFR (after spinning) | | g/10 min. | 29 | 30 | 30 |
| 2nd Component | Polymer (resin) | | | HDPE | LLDPE | LDPE |
| | Melting point | | ° C. | 132.0 | 123.1 | 108.4 |
| Spinning condition | Composite configuration | | | FIG. 1 | FIG. 2 | FIG. 2 |
| | Ratio of sheath/core | | Weight ratio | 50:50 | 50:50 | 40:60 |
| | Spinning temperature | | ° C. | 250 | 250 | 250 |
| | Fineness of unstretched fiber | | dtex | 8.0 | 8.2 | 10.2 |
| Stretching condition | Stretching temperature | | ° C. | 90 | 90 | 90 |
| | Stretching ratio | | Times | 4.4 | 4.7 | 3.8 |
| | Shape of crimps | | | Mechanical crimps | Three dimensional crimps | Mechanical crimps |
| | Number of crimps | | crimps/2.54 cm | 14.1 | 11.9 | 13.9 |
| Property of fiber | Fineness | | dtex | 2.0 | 2.3 | 3.2 |
| Thermal shrinkage | MD/CD | | %/% | 75/70 | 76/74 | 62/53 |
| Processability | Spinnability | | | Very Good | Very Good | Very Good |
| | Cardability | | | Suitable | Suitable | Suitable |
| State of non-woven fabric | Uniformity | | | Very Good | Very Good | Very Good |
| | Touch feeling | | | 4 | 3 | 3 |

HDPE: High density polyethylene
LLDPE: Linear low density polyethylene
LDPE: Low density polyethylene
Co-PP: Propylene copolymer

TABLE 3

| | | | | Comparative Example 1 | Comparative Example 2 | Comparative Example 3 |
|---|---|---|---|---|---|---|
| 1st component | Polymer (resin) | | | PP | Co-PP | Co-PP |
| | Monomers | Propylene | wt % | 98.30 | 96.60 | 93.35 |
| | | Ethylene | wt % | 1.70 | 3.40 | 4.00 |
| | | Butene-1 | wt % | 0 | 0 | 2.65 |
| | Melting point TM | | ° C. | 150.8 | 137.0 | 126.4 |
| | MFR (before spinning) | | g/10 min. | 21 | 16 | 16 |
| | MFR (after spinning) | | g/10 min. | 35 | 30 | 30 |
| 2nd Component | Polymer (resin) | | | HDPE | PET | PP |
| | Melting point | | ° C. | 132.0 | 252.7 | 162.0 |
| Spinning condition | Composite configuration | | | FIG. 1 | FIG. 1 | Concentric sheath-core |
| | Ratio of sheath/core | | Weight ratio | 50:50 | 50:50 | 50:50 |
| | Spinning temperature | | ° C. | 250 | 250 | 250 |
| | Fineness of unstretched fiber | | dtex | 3.9 | 6.2 | 6.2 |
| Stretching condition | Stretching temperature | | ° C. | 90 | 90 | 75 |
| | Stretching ratio | | Times | 2.4 | 3.3 | 3.3 |
| | Shape of crimps | | | Mechanical crimps | Mechanical crimps | Mechanical crimps |
| | Number of crimps | | crimps/2.54 cm | 12.7 | 12.4 | 13.1 |
| Property of fiber | Fineness | | dtex | 2.1 | 2.3 | 2.1 |
| Thermal shrinkage | MD/CD | | %/% | 10/6 | 16/10 | 19/11 |
| Processability | | Spinnability | | Very Good | Good | Very Good |
| | | Cardability | | Suitable | Not Suitable | Suitable |
| State of non-woven fabric | | Uniformity | | Bad | Bad | Bad |
| | | Touch feeling | | 1 | 1 | 1 |

HDPE: High density polyethylene
PET: Polyester
PP: Crystalline polypropylene
Co-PP: Propylene copolymer Referring to Comparative Example 1, the crystalline polypropylene (including 1.70 wt % of ethylene as comonomer) used for the first component had poor thermal shrinkage, so that the thermal shrinkage of the web using composite fiber in Example 1 was extremely low. Further to Comparative Example 2, while the first component of the fiber was the same as used for the first component in Example 1, polyester used for the second component was rigid, so that thermal shrinkage did not occur and lofty non-woven fabric was not obtained. In Comparative Example 3, the configuration of the fiber was concentric sheath-core type, so that enough crimps did not emerge. Furthermore to Comparative Example 2 and 3, the fibers did not shrink under thermal treatment at 145° C., and non-woven fabric was not obtained.

Examples 9–12, Comparative Examples 4–5

One of ethylene-propylene-butene-1 copolymer, ethylene-propylene copolymer or crystalline polypropylene and one of high density polyethylene, linear low density polyethylene, crystalline polypropylene or ethylene-propylene-buten-1 copolymer were employed as the first and second component of composite fibers respectively. Fibers and non-woven fabrics were obtained according to the following method. The physical property of the obtained non-woven fabrics of spun-bonded continuous fiber was measured and examined.

With using spinneret to obtain arbitrary cross sectional shape of each fiber, filaments of composite fiber extruded from the spinneret were introduced into air gun type attenuater, then drawn and stretched to give continuous composite fiber. Sequentially, the above continuous fiber filaments taken out from the air gun were electrified with static charger, then opened by colliding onto reflecting board, the opened continuous fiber filaments were collected on endless track net conveyer equipped with sucker on backside to form continuous fiber web.

The data of each composite fiber and non-woven fabric are shown in Table 4 as Examples 9–12, Table 5 as Comparative Examples 4–5.

TABLE 4

| | | | | Example 9 | Example 10 | Example 11 | Example 12 |
|---|---|---|---|---|---|---|---|
| 1st component | Polymer (resin) | | | Co-PP | Co-PP | Co-PP | Co-PP |
| | Monomers | Propylene | wt % | 93.35 | 94.00 | 93.50 | 95.60 |
| | | Ethylene | wt % | 4.00 | 1.00 | 5.50 | 4.40 |
| | | Butene-1 | wt % | 2.65 | 5.00 | 1.00 | 0 |
| | Melting point TM | | ° C. | 126.4 | 142.0 | 124.0 | 136.8 |
| | MFR (before spinning) | | g/10 min. | 16 | 18 | 20 | 8 |
| | MFR (after spinning) | | g/10 min. | 30 | 36 | 40 | 23 |
| 2nd Component | Polymer (resin) | | | LLDPE | HDPE | LLDPE | HDPE |
| | Melting point | | ° C. | 120.7 | 132.0 | 120.7 | 132.0 |
| Spinning condition | Composite configuration | | | FIG. 1 | FIG. 1 | FIG. 1 | FIG. 1 |
| | Ratio of sheath/core | | Weight ratio | 50:50 | 50:50 | 50:50 | 50:50 |

TABLE 4-continued

| | | | Example 9 | Example 10 | Example 11 | Example 12 |
|---|---|---|---|---|---|---|
| | Spinning temperature | ° C. | 280 | 280 | 280 | 280 |
| | Drawing speed | m/min. | 4091 | 4091 | 4091 | 4091 |
| Property of fiber | Fineness | Dtex | 1.1 | 1.1 | 1.1 | 1.1 |
| Thermal shrinkage | MD/CD | %/% | 78/62 | 60/45 | 84/69 | 80/66 |
| Processability | Openability | | Very Good | Very Good | Very Good | Very Good |
| State of non-woven fabric | Formation | | Very Good | Very Good | Very Good | Very Good |
| | Touch feeling | | 4 | 4 | 4 | 4 |

HDPE: High density polyethylene
LLDPE: Linear low density polyethylene
Co-PP: Propylene copolymer

TABLE 5

| | | | Comparative Example 4 | Comparative Example 5 |
|---|---|---|---|---|
| 1st component | Polymer (resin) | | Co-PP | PP |
| | Monomers Propylene | wt % | 93.35 | 100 |
| | Ethylene | wt % | 4.00 | 0 |
| | Butene-1 | wt % | 2.65 | 0 |
| | Melting point TM | ° C. | 126.4 | 162.0 |
| | MFR (before spinning) | g/10 min. | 16 | 35 |
| | MFR (after spinning) | g/10 min. | 30 | 50 |
| 2nd Component | Polymer (resin) | | PP | Co-PP |
| | Melting point | ° C. | 162 | 126.4 |
| Spinning condition | Composite configuration | | Concentric sheath-core | FIG. 1 |
| | Ratio of sheath/core | Weight ratio | 50:50 | 50:50 |
| | Spinning temperature | ° C. | 280 | 280 |
| | Drawing speed | m/min. | 4091 | 4091 |
| Property of Fiber | Fineness | dtex | 1.1 | 1.1 |
| Thermal shrinkage | MD/CD | %/% | 19/13 | 55/50 |
| Processability | Openability | | Bad | Bad |
| State of non-woven fabric | Uniformity | | Bad | Bad |
| | Touch feeling | | 1 | 2 |

PP: Polypropylene
Co-PP: Propylene copolymer

Referring to Comparative Example 4, the composite configuration was concentric sheath-core, so that the fiber of the produced web did not crimp under thermal treatment, so that it was impossible to obtain lofty non-woven fabric. Further to Comparable Example 5, the first component was polypropylene which does not have thermal shrinkage, so that lofty non-woven fabric could not be obtained.

Effect of the Invention

The potentially crimpable composite fiber of this invention provides the following excellent effects with using propylene copolymer having specific comonomer ratio as the component of composite fiber.

(1) The crimps can be actualized in the web under the thermal treatment at the same time of the non-woven fabrication, so that productivity of the non-woven fabric is excellent.

(2) The potential crimps can be actualized in the web under the thermal treatment, so that lofty non-woven fabrics can be obtained. Especially for continuous fibers spun by the spunbonding or the melt-blowing method comprising no crimping means, it is possible to provide crimps, and to obtain lofty non-woven fabrics.

(3) In the case of short fibers (staples), uniform web can be obtained at the time of carding process by reduced surface friction of the fibers. The crimps can be actualized in the web under the thermal treatment, so that lofty non-woven fabrics having good uniformity can be obtained.

What is claimed is:

1. A potentially crimpable composite fiber comprising;

a propylene copolymer having melting point (Tm) of 120° C. to 147° C. consisting of 90 to 98 weight % of propylene and 2 to 10 weight % of (α-olefin other than propylene as the first component, and a polyethylene as the second component, wherein its composite configuration of the first and the second components is eccentric sheath-core configuration where the second component is arranged as the sheath component, and the area ratio of the first component to the second component in cross section of the fiber is 65/35 to 35/65.

2. The potentially crimpable composite fiber according to claim 1, wherein the propylene copolymer of the first component consists of 90 to 96 weight % of propylene and 4 to 10 weight % of α-olefin other than propylene.

3. The potentially crimpable composite fiber according to claim 1, wherein the propylene copolymer of the first component is an ethylene—propylene—butene-1 copolymer consisting of 90 to 96 weight % of propylene, 3 to 7 weight % of ethylene and 1 to 5 weight % of butene-1.

4. The potentially crimpable composite fiber according to claim 1, wherein the second component consists of at least one selected from a group of a high density polyethylene, a linear low density polyethylene and a low density polyethylene.

5. The potentially crimpable composite fiber according to claim 1, wherein the melting point of the second component is lower than that of the first component (Tm).

6. The potentially crimpable composite fiber according to claim 1, wherein the potentially crimpable composite fiber is a continuous filament.

7. A non-woven fabric comprising the potentially crimpable composite fiber according to claim 1.

* * * * *